US005800976A

United States Patent [19]

Dickerson et al.

[11] Patent Number: 5,800,976

[45] Date of Patent: *Sep. 1, 1998

[54] RADIOGRAPHIC ELEMENTS THAT SATISFY IMAGE AND TONE REQUIREMENTS WITH MINIMAL SILVER

[75] Inventors: Robert E. Dickerson, Hamlin; Anthony Adin, Rochester; Marcia K. Hansen, Fairport, all of N.Y.

[73] Assignee: Eastman Kodak Company, Rochester, N.Y.

[*] Notice: The term of this patent shall not extend beyond the expiration date of Pat. No. 5,759,759.

[21] Appl. No.: 864,421

[22] Filed: May 28, 1997

Related U.S. Application Data

[63] Continuation-in-part of Ser. No. 801,767, Feb. 18, 1997, abandoned.

[51] Int. Cl.[6] ..... G03C 1/04; G03C 5/16

[52] U.S. Cl. ..... 430/567; 430/569; 430/603; 430/631; 430/966

[58] Field of Search ..... 430/567, 569, 430/966, 603, 631

[56] References Cited

U.S. PATENT DOCUMENTS

| | | | |
|---|---|---|---|
| 3,271,158 | 9/1966 | Allentoff | 430/567 |
| 3,272,631 | 9/1966 | Garrett et al. | 430/603 |
| 3,514,289 | 5/1970 | Goffe et al. | 430/638 |
| 4,013,470 | 3/1977 | Landon, Jr. | 430/523 |
| 4,414,304 | 11/1983 | Dickerson | 430/353 |
| 4,865,958 | 9/1989 | Abbott et al. | 430/542 |
| 5,292,627 | 3/1994 | Hershey et al. | 430/356 |
| 5,292,631 | 3/1994 | Hershey et al. | 430/567 |
| 5,633,126 | 5/1997 | Dickerson et al. | 430/496 |
| 5,716,769 | 2/1998 | Dickerson et al. | 430/521 |

FOREIGN PATENT DOCUMENTS

| | | |
|---|---|---|
| 1004302 | 9/1965 | United Kingdom . |
| 1049052 | 11/1966 | United Kingdom . |
| 1237541 | 6/1971 | United Kingdom . |
| 1269963 | 4/1972 | United Kingdom . |

OTHER PUBLICATIONS

Research Disclosure, vol. 184, Aug. 1979, Item 18431 E.

*Primary Examiner*—Mark F. Huff
*Attorney, Agent, or Firm*—Carl O. Thomas

[57] ABSTRACT

A dual-coated radiographic element is disclosed comprised of a blue tinted film support having coated on each of its faces a spectrally sensitized high bromide tabular grain emulsion. The properties of a maximum density of at least 3.0, an average contrast of at least 2.7, and a b* value more negative than −5.0 at a silver coating coverage on each major surface of the support of less than 12 mg/dm$^2$, are imparted by (1) the support having a neutral density of at least 0.18, (2) tabular grains accounting for at least 90 percent of total grain projected area having a mean thickness of 0.2 micrometer or less and a coefficient of variation of equivalent circular diameter less than 20 percent, (3) a covering power enhancing compound containing at least one divalent sulfur atom adsorbed to surfaces of the silver halide grains, (4) a water soluble polymer chosen from the class consisting of polyacrylamide and dextran, in a weight ratio of the polymer to the gelatino-vehicle of at least 0.1:1, and (5) hardening of the gelatino-vehicle being chosen to allow a weight gain following processing and before drying of greater than 200 percent, based on the total weight of gelatino-vehicle.

12 Claims, No Drawings

RADIOGRAPHIC ELEMENTS THAT SATISFY IMAGE AND TONE REQUIREMENTS WITH MINIMAL SILVER

This is a continuation-in-part of U.S. Ser. No. 08/801,767, filed Feb.18, 1997, now abandoned.

FIELD OF THE INVENTION

The invention relates to radiography. More specifically, the invention relates to silver halide emulsion layer containing radiographic elements.

DEFINITION OF TERMS

In referring to grains and emulsions containing two or more halides, the halides are named in order of ascending concentrations.

The term "high bromide" in referring to grains and emulsions indicates that bromide is present in a concentration of greater than 50 mole percent, based on silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The term "coefficient of variation" or "COV" is defined as the standard deviation (a) of grain ECD divided by mean grain ECD.

The term "average contrast" or "$\gamma$" is defined as the slope of a line drawn between characteristic curve points of 0.25 and 2.0 above minimum density ($D_{min}$).

Covering power is defined as 100 times the ratio of maximum density to developed silver expressed in milligrams per square decimeter.

The terms "front" and "back" in referring to radiographic imaging are used to designate locations nearer to and farther from, respectively, the source of X-radiation than the support of the radiographic element.

The term "dual-coated" is used to indicate a radiographic element having emulsion layers coated on both the front and back sides of its support.

The terms "colder" and "warmer" in referring to image tone are used to mean CIELAB b* values measured at a density of 0.6 (single-sided) or 1.0 (dual-coated) above minimum density that are more negative or positive, respectively. The b* measurement technique is described by Billmeyer and Saltzman, *Principles of Color Technology*, 2nd. Ed., Wiley, N.Y., 1981, at Chapter 3. The b* values describe the yellowness vs. blueness of an image with more positive values indicating a tendency toward greater yellowness.

*Research Disclosure* is published by Kenneth Mason Publications, Ltd., Dudley House, 12 North St., Emsworth, Hampshire P010 7DQ, England.

BACKGROUND OF THE INVENTION

In medical diagnostic radiography the object is to obtain a viewable silver image from which a medical diagnosis can be made while exposing the patient to a minimal dose of X-radiation. Patient exposure to X-radiation is minimized by employing a dual-coated radiographic element in combination with front and back fluorescent intensifying screens. A portion of the X-radiation transmitted through the patient's anatomy is absorbed by each of the front and back intensifying screens. Each screen emits light in response to X-radiation exposure, and the emitted light from the front and back screens imagewise exposes the front and back emulsion layers of the dual-coated radiographic element. With this arrangement, patient exposure to X-radiation can be reduced to about 5 percent of the X-radiation exposure level that would be required for comparable imaging using a single emulsion layer and no intensifying screen.

Unlike photographic images, which are taken in small formats and then enlarged for viewing, radiographic images are normally viewed without enlargement. Thus, very large formats by photographic standards are required. Further, unlike color photography, wherein silver is reclaimed in processing, the silver in radiographic elements is often not reclaimed for years, since the images are required to be available to substantiate diagnoses. Further, usually a number of images are obtained when subject matter of pathological interest is observed.

Thus, there has been in medical diagnostic imaging a long standing need to minimize to the extent feasible the silver contained in the elements. Silver coating coverage reductions have been limited by performance requirements. Sufficient silver is required to achieve a maximum image density ($D_{max}$) of at least 3.0 and to maintain an average contrast ($\gamma$) of at least 2.7.

An early approach to reducing silver coating coverages while satisfying these performance requirements was to employ organic covering power increasing addenda in the emulsions. The water soluble polymers dextran, poly (vinylpyrrolidone) and polyacrylamide have been incorporated into emulsion layers to increase covering power, as illustrated by Allentoff et al U.S. Pat. No. 3,271,158, Garrett et al U.S. Pat. No. 3,272,631 and Goffe et al U.S. Pat. No. 3,514,289. Other covering power enhancing compounds are disclosed by *Research Disclosure*, Vol. 184, August 1979, Item 18431, E. Stabilization of Radiographic Materials Comprising Covering Power Addenda.

A common approach was to maximize covering power by employing an organic covering power enhancer and to foreharden the emulsion layers only partially, relying on a prehardener to complete hardening in the course of processing.

Dickerson et al U.S. Pat. No. 4,414,304 recognized that tabular grain emulsions provide sufficient covering power to be fully forehardened. At levels of hardening high enough to allow processing solution hardener to be eliminated, the covering power of the tabular grain emulsions of Dickerson et al is shown to vary little as a function of hardening. Further, Dickerson et al demonstrated that covering power increases as the average thickness of the tabular grains decreases.

When attempts were made to minimize silver coating coverages employing tabular grain emulsions, the problem was encountered that reducing the thickness of the tabular grains leads to warmer image tones. This has limited the minimum tabular grain thicknesses that can be employed in radiographic elements. This has in turn resulted in silver coating coverages that, while lower than those employed prior to the use of tabular grain emulsions, are still higher than the minimum values that are capable of otherwise satisfying image structure requirements.

Another problem that has arisen from the use of tabular grain emulsions is residual dye stain. Higher ratios of spectral sensitizing dye to silver are required to optimally sensitize tabular grain emulsions as compared to nontabular grain emulsions. This results in higher concentrations of spectral sensitizing dye that must be removed during processing to avoid residual dye stain.

Hershey U.S. Pat. No. 5,292,631 discloses alkylthio-substituted azoles to be effective to increase the covering power of high bromide tabular grain emulsions. The alkylthio-substituted azoles are capable of forming relatively insoluble silver salts.

Hershey U.S. Pat. No. 5,292,627 discloses a sub-set of these same compounds, those in which the alkythio substituent is an alkylthioalkylthio substituent, to be useful to provide colder image tones in high bromide silver halide emulsions, provided the mean ECD of the grains is less than 0.3 μm. This, of course, excludes the vast majority of tabular grain emulsions, since the mean ECD of tabular grain emulsions is in all but very rare instances greater than 0.3 μm.

Compounds that contain a —S— or =S moiety are illustrated by U.K. Patents 1,004,302, 1,049,052, 1,237,541, and 1,269,9632, under at least some circumstances, to produce colder image tones and to increase silver image density (thereby increasing covering power).

Landon U.S. Pat. No. 4,013,470 employs heterocyclic mercaptans in combination with heterocyclic quaternary ammonium salts to obtain warmer image tones in a black-and-white print material.

From these teachings it is apparent that the art has by now studied the individual components known to be useful in high bromide silver halide emulsions. However, the teachings above demonstrate distinctive (and in some cases surprising) properties to arise from combinations of emulsion grains and addenda.

RELATED APPLICATION

Applicants' U.S. Ser. No. 08/864,088, filed concurrently herewith, and now allowed a continuation-in-part of now abandoned U.S. Ser. No. 08/801,538, filed Feb. 18, 1997, commonly assigned, titled RADIOGRAPHIC ELEMENTS EXHIBITING INCREASED COVERING POWER AND COLDER IMAGE TONES, discloses and claims a dual-coated radiographic element containing high bromide tabular grain emulsion layers exhibiting increased covering power and colder image tones. A covering power enhancing compound containing at least one divalent sulfur atom adsorbed to grain surfaces and a gelatino-vehicle are present in the emulsion layers. The emulsion layers additionally include a water soluble polymer chosen from the class consisting of polyacrylamide and dextran.

SUMMARY OF THE INVENTION

In one aspect this invention is directed to a radiographic element comprised of a blue tinted film support having first and second major surfaces and, coated on each of the major surfaces of the support, at least one layer containing a tabular grain emulsion including a gelatino-vehicle and spectrally sensitized silver halide grains containing greater than 50 mole percent bromide and less than 3 mole percent iodide, based on silver, wherein the properties of a maximum density of at least 3.0, an average contrast of at least 2.7, and a b* value more negative than −5.0 at a silver coating coverage on each major surface of the support of less than 12 mg/dm$^2$, are imparted by (1) the support having a neutral density of at least 0.18, (2) tabular grains accounting for at least 90 percent of total grain projected area having a mean thickness of 0.2 micrometer or less and a coefficient of variation of equivalent circular diameter less than 20 percent, (3) a covering power enhancing compound containing at least one divalent sulfur atom adsorbed to surfaces of the silver halide grains, (4) a water soluble polymer chosen from the class consisting of polyacrylamide and dextran, in a weight ratio of the polymer to the gelatino-vehicle of at least 0.1:1, and (5) hardening of the gelatino-vehicle being chosen to allow a weight gain of greater than 200 percent, based on the total weight of gelatino-vehicle, after the following process cycle:

| | |
|---|---|
| development | 24 seconds at 40° C. |
| fixing | 20 seconds at 40° C., |
| washing | 10 seconds at 40° C., |

when the developer exhibits the composition:

| | |
|---|---|
| hydroquinone | 30 g |
| 4-hydroxymethyl-4-methyl-1-phenyl-3-pyrazolidinone | 1.5 g |
| KOH | 21 g |
| $NaHCO_3$ | 7.5 g |
| $K_2SO_3$ | 44.2 g |
| $Na_2S_2O_5$ | 12.6 g |
| 5-methylbenzotriazole | 0.06 g |
| glutaraldehyde | 4.9 g |
| water to 1 liter (pH = 10) | |

while allowing subsequent drying at 65° C. within 20 seconds.

It has been discovered quite surprisingly that radiographic images of acceptable maximum density and contrast as well as acceptable image tone can be realized with minimal silver coating coverages with a combination of tabular grain, covering power enhancer, and hardener level selections that have never previously been considered by those skilled in the art.

DESCRIPTION OF PREFERRED EMBODIMENTS

An exposure assembly, including a dual-coated radiographic element satisfying the requirements of the invention, is schematically illustrated as follows:

| Assembly I |
|---|
| Front Screen Support (FSS) |
| Front Luminescent Layer (FLL) |
| Front Hydrophilic Colloid Layer Unit (FHCLU) |
| Blue Tinted Transparent |
| Film Support (BTTFS) |
| Back Hydrophilic Colloid Layer Unit (BHCLU) |
| Back Luminescent Layer (BLL) |
| Back Screen Support (BSS) |

A dual-coated radiographic element satisfying the requirements of the invention is formed by FHCLU, BTTFS and BHCLU. Prior to imagewise exposure to X-radiation, the dual-coated radiographic element, a front intensifying screen, formed by FSS and FLL, and a back intensifying screen, formed by BSS and BLL, are mounted in the orientation shown in a cassette (not shown), but with the screens and film in direct contact.

X-radiation in an image pattern passes through FSS and is, in part, absorbed in FLL. The front luminescent layer re-emits a portion of the absorbed X-radiation energy in the form of a light image, which exposes one or more silver halide emulsion layers contained in FHCLU. X-radiation that is not absorbed by the front screen passes through the dual-coated radiographic element with minimal absorption to reach BLL in the back screen. BLL absorbs a substantial portion of the X-radiation received and re-emits a portion of the X-radiation energy in the form of a light image that exposes one or more silver halide emulsion layers contained in BHCLU.

In the simplest possible construction of the radiographic elements of this invention each FHCLU and BHCLU consist of a single tabular grain emulsion containing:

(a) high bromide grains, (b) adsorbed to surfaces of the high bromide grains a covering power enhancing compound containing at least one divalent sulfur atom, (c) a water soluble polymer chosen from the class consisting of polyacrylamide and dextran, and (d) a gelatino-vehicle.

The high bromide grains greater than 50 mole percent bromide, based on silver, and less than 3 mole iodide, based on silver. Any halide other than bromide and iodide can be chloride and can account for up to (but not including) 50 mole percent of total halide, based on silver. Preferably chloride, if present, is limited to less than 10 mole percent, based on silver. Preferred silver halide grain compositions are silver bromide and silver iodobromide, with silver chlorobromide, silver iodochorobromide and silver chloroiodobromide also being contemplated.

Tabular grains account for at least 90 percent of total grain projected area. With this high percentage of total grains being accounted for by tabular grains it is possible to realize a coefficient of variation (COV), based on total grain ECD's, of less than 20 percent, preferably less than 15 percent, and, optimally, less than 10 percent. In highly uniform grain emulsions tabular grains have been observed to account for substantially all (>97%) of total grain projected area. The COV contributes to maintaining an acceptable average contrast (at least 2.7).

The grains have a mean ECD that seldom exceeds 5 μm. The emulsions in the radiographic elements of this invention in all instances exhibit a mean ECD of greater than 0.3 μm and preferably greater than 0.5 μm.

To allow a maximum density of at least 3.0 to be realized at a minimal silver coating coverage (less than 12 mg/dm$^2$), the mean thickness (t) of the tabular grains is limited to 0.2 μm or less. Mean tabular grain thicknesses down to 0.1 μm or less are contemplated.

The high bromide grains described above cannot achieve an acceptable maximum density level or an acceptable image tone when coated at a silver coverage of less than 12 mg/dm$^2$ absent further modification of the emulsion. It has been discovered quite unexpectedly that both image tone and covering power (and hence maximum density) can be both be improved by coating with the grains a combination of the category (b) and (c) addenda named above.

The category (b) component can be chosen from among a wide variety of compounds that absorb to silver halide grain surfaces and contain at least one divalent sulfur atom. The divalent sulfur atom can take the form of a —S— or =S moiety. When the sulfur atom is present as a —S— moiety, it typically links two carbon atoms, two nitrogen trivalent nitrogen atoms, or a carbon atom and a trivalent nitrogen atom. When the sulfur atom is present as a =S moiety, it forms a thioxocarbonyl (C=S) moiety. Most commonly the adsorbed covering power enhancer contains an azole or azine ring. The thioxocarbonyl and —S— can form a portion of the azole or azine ring. Additionally or alternatively the —S— moiety can be present as a ring substituent.

In one common form the adsorbed covering power enhancers are the 5-mercaptotetrazoles. In these compounds the 5-position divalent sulfur atom (—S—) can also, in one tautomeric form, rearrange to a thioxocarbonyl (C=S) moiety. As illustrated by U.K. Patent 1,004,302, cited above, 5-mercaptotetrazoles include the following representative compounds: 1-phenyl-5-mercaptotetrazole, 1-(α-naphthyl)-5-mercaptotetrazole, 1-cyclohexyl-5-mercaptotetrazole, 1-methyl-5-mercaptotetrazole, 1-ethyl-5-mercaptotetrazole, 1-allyl-5-mercaptotetrazole, 1-isopropyl-5-mercaptotetrazole, 1-benzoyl-5-mercaptotetrazole, 1-p-chlorophenyl-5-mercaptotetrazole, 1-p-methylphenyl-5-mercaptotetrazole, 1-p-methoxycarbonylphenyl-5-mercaptotetrazole, and 1-p-diethylaminophenyl-5-mercaptotetrazole.

In another form covering power enhancing agents satisfying category (b) requirements are dithioxotriazoles of the type disclosed by U.K. Patent 1,237,541, cited above. These compounds are 1,3,5-triazoles with two of the three ring carbon atoms forming thioxocarbonyl (C=S) moieties. Representative examples of these compounds include: 1-phenyl-2,4-dithioxo-1,2,3,4-tetrahydro-1,3,5-triazine, 1-cyclohexyl-2,4-dithioxo-1,2,3,4-tetrahydro-1,3,5-triazine, 1-benzyl-2,4-dithioxo-1,2,3,4-tetrahydro-1,3,5-triazine, and 1-p-tolyl-2,4-dithioxo-1,2,3,4-tetrahydro-1,3,5-triazine.

In an additional form the overall ring structure is that of an indene or indan, but with at least one nitrogen atom located in the five or six membered ring and, often, both of these rings. The sulfur atom is attached to a ring carbon atom adjacent a ring nitrogen atom.

In this form U.K. Patent 1,257,750, cited above, discloses 4,6-dimercapto-1,2,5,7-tetraazaindenes to be useful covering power enhancing addenda satisfying category (b). Specifically disclosed compounds include 1-R-10 4,6-dimercapto-1,2,5,7-tetraazindenes, where R is hydrogen, methyl, phenyl, pyrimidin-4-yl, 3-carboxyphenyl, 4-carboxyphenyl, or 2,4-diphenyl-1,3,5-triazin-6-yl.

Another preferred form of tetraazaindenes for satisfying component (b) requirements are 1,3,3a,7-and 1,3,3a,4-tetraazindenes with a mercapto (—SH) or substituted mercapto (—SR) substituent, where R is preferably alkyl of from 1 to 11 carbon atoms. These compounds include: 2,6-dimethyl-4-mercapto-1,3,3a,7-tetraazaindene, 5-ethyl-7-mercapto-6-methyl-1,3,3a,4-tetraazaindene, 5-bromo-4-mercapto-6-methyl-1,3,3a,7-tetraazaindene, 4-hydroxy-2-mercapto-6-methyl-1,3,3a,7-tetraazaindene, and analogues of the compounds that contain a $C_1$–$C_{11}$ alkyl substituent replacing the mercapto hydrogen atom. These and other useful tetraazaindene compounds are disclosed by Landon U.S. Pat. No. 4,013,470, Rowland et al U.S. Pat. No. 4,728,601, and Adin U.S. Pat. No. 5,256,519, the disclosures of which are here incorporated by reference.

It is additionally contemplated to employ category (b) covering power enhancers of the type disclosed by Hershey U.S. Pat. Nos. 5,292,627 and 5,292,631, the disclosures of which are here incorporated by reference. These covering power enhancers contain as a common feature a 1 ,2,4-triazole ring contains a 5-position substituent satisfying the formula:

$$T—[S—(CH_2)_p—]_n—S—L_m—$$

wherein

L is a divalent linking group containing from 1 to 8 carbon atoms (e.g., from 1 to 8 methylene groups);

m is 0 or 1;

n is an integer of from 0 to 4;

p is an integer of from 2 to 4; and

T is an aliphatic moiety (e.g., alkyl) containing from 1 to 10 carbon atoms.

The 1,2,4-triazole ring can contain an additional 3-position nitrogen atom to form a tetrazole ring. Additionally the triazole ring can be fused with an azine ring to form a 1,3,3a,7-tetraazindene ring structure.

In another preferred form the indene type compound can contain a 1 or 3 ring position trivalent nitrogen atom and a 2 ring position mercapto (or substituted mercapto, as described above) substituent. Illustrative compounds include: 2-mercaptobenzoxazole, 2-mercaptobenzothiazole, and 2-mercaptobenzimidazole. These compounds are illustrated by Landon U.S. Pat. No. 4,013,470, cited and incorporated by reference above. In its "M" series of compounds Landon illustrates still other mercapto-substituted azole and azine useful in the practice of this invention.

As illustrated in the Examples below rhodanine, an azole ring compound that contains a thioxocarbonyl (C=S) ring member, is shown to be useful in the practice of this invention. The rhodanine ring has no corresponding mercapto tautomer. Thus, it is clear that a mercapto substituent is not an essential characteristic of the category (b) covering power enhancers. Other, comparable ring compounds having at least one thioxocarbonyl ring member include isorhodanine, 2- or 4-thiohydantoin, 2-thiooxazolidine-2,4-dione, and 2-thiobarbituric acid.

Each of these ring structures are common acidic nuclei of merocyanine dyes. Thus, it is specifically recognized that the category (b) covering power enhancer can, if desired, include the substituents necessary to complete a merocyanine dye chromophore. The following are illustrations of merocyanine dyes that can be used as category (b) covering power enhancers:

| | |
|---|---|
| D-1 | 5-[(3-Ethyl-2[3H]-benzoxazolidene)ethylidene]-rhodanine; |
| D-2 | 5-p-Diethylaminobenzylidene-2-thiobarbituric acid; |
| D-3 | 3-Ethyl-5-[(3-ethyl-2[3H]-benzoxazolidene)ethylidene]rhodanine; |
| D-4 | 3-Ethyl-5-[(3-methyl-2[3H]-thiazolylidene)ethylidene]rhodanine; |
| D-5 | 3-Carboxymethyl-5-(3-methyl-2[3H]-benzothiazolidene)rhodanine; |
| D-6 | 3-Ethyl-5-[(3-ethyl-2[3H]-benzoxazolylidene)ethylidene]-1-phenyl-2-thiohydantoin; |
| D-7 | 3-Ethyl-5-[(3-methyl-2[3H]-thiazolinylidene)ethylidene]-2-thio-2,4-oxazolidinedione; |
| D-8 | 3-Ethyl-5-[(1-ethylnaphtho[1,2-d]thiazolin-2-ylidene)-1-methylthethylidene]rhodanine; |
| D-9 | 3-Ethyl-5-(3-piperidinoallylidene)rhodanine; |
| D-10 | 5-(3-Ethyl-2[3H]-benzoxazolylidene)-3-phenylrhodanine; |
| D-11 | 3-Ethyl-5-[(1-ethyl-4[1H]-pyridylidene)rhodanine; |
| D-12 | 3-Ethyl-5-[(1-piperidyl)methylene]rhodanine; |
| D-13 | 3-Ethyl-5-[4-(3-ethyl-2-benzoselenazolinylidene)-2-butenylidene]-1-phenyl-2-thiohydantoin; |
| D-14 | 5-[(3-Ethyl-2[3H]-benzothiazolylidene)ethylidene-3-n-heptyl-1-phenyl-2-thiohydantoin; |
| D-15 | 5-[(3-Ethyl-2[3H]-benzothiazolylidene)ethylidene]-3-n-heptyl-1-phenyl-2-thio-2,4-dioxazolidenedione; |
| D-16 | 5-[(1,3,3-Trimethyl-2-indolinylidene)ethylidene-rhodanine; |
| D-17 | Bis[1,3-diethyl-2-thiobarbituric acid-(5)]-pentamethineoxonol; |
| D-18 | 5-[(3-Ethyl-2[3H]-benzoxazolylidene)ethylidene]-3-β-sulfoethyl-2-thio-2,4-oxazolidenedione; |
| D-19 | 3-Carboxymethyl-5-[(3-methyl-2[3H]-benzoxazolidene)ethylidene]rhodanine; and |
| D-20 | 5-(3-Ethyl-2-benzothiazolinylidene)-3-β-sulfo-ethylrhodanine. |

Generally any conventional covering power enhancing amount of the component (b) can be incorporated in the emulsion layers of the radiographic elements of the invention. Generally concentrations of component (b) ranging from 20 to 2000 mg/Ag mole are effective, with concentrations of from 30 to 700 mg/Ag mole being preferred.

The category (c) addenda are water soluble polymers. The water soluble polymers polyacrylamide and dextran have been found to be effective. Any form of these polymers that can be dissolved in the emulsion can be employed in the practice of the invention. Useful concentrations of the category (c) addenda include at least a 0.1:1 weight ratio of the category (c) component to gelatino-vehicle in the emulsion layer. The component (c) to gelatino-vehicle weight ratio is contemplated to range from 0.1:1 to 1:1 for the majority of applications, with a weight ratio of from 0.25:1 to 0.75:1 being preferred. It was entirely surprising that the category (c) addenda polyacrylamide and dextran produced colder image tones while other water soluble polymers, such as polyvinyl alcohol and polyvinylpyrrolidone, known to provide similar covering power enhancement effects shifted image tone toward substantially warmer b* values.

The emulsion grains are suspended in a gelatino-vehicle. The vehicle can be gelatin—e.g., alkali-treated gelatin (cattle bone or hide gelatin) or acid-treated gelatin (pigskin gelatin)—or gelatin derivatives—e.g., acid-treated gelatin, such as acetylated gelatin or phthalated gelatin.

To allow maximum density requirements to be satisfied with minimal silver coating coverages it is necessary to limit the forehardening of the gelatino-vehicle. Whereas it has become the typical practice to fully foreharden radiographic elements containing tabular grain emulsions, the radiographic elements of this invention are only partially forehardened, with final hardening being accomplished by incorporating a prehardener in the developer, as was the standard practice prior to the teachings of Dickerson U.S. Pat. No. 4,414,304.

The degree of forehardening is quantified by reference to the following standard rapid access processing cycle:

| | |
|---|---|
| development | 24 seconds at 40° C. |
| fixing | 20 seconds at 40° C., |
| washing | 10 seconds at 40° C., |
| drying | 20 seconds at 65° C., |

To realize an acceptable maximum density at a minimal silver coating coverage, hardening is limited to allow a weight gain of greater than 200 percent (preferably at least 220 percent), based on total weight of the gelatino-vehicle, by the end of the washing step, where the development step is employed using a developer that exhibits the composition:

| | |
|---|---|
| hydroquinone | 30 g |
| 4-hydroxymethyl-4-methyl-1-phenyl-3-pyrazolidinone | 1.5 g |
| KOH | 21 g |
| $NaHCO_3$ | 7.5 g |
| $K_2SO_3$ | 44.2 g |
| $Na_2S_2O_5$ | 12.6 g |
| 5-methylbenzotriazole | 0.06 g |
| glutaraldehyde | 4.9 g |
| water to 1 liter (pH = 10). | |

This test establishes the maximum amount of forehardening contemplated in the radiographic elements of the invention. The minimum amount of forehardening is established by the requirement that the radiographic element emerge dry by the end of the drying step. That is, the radiographic element must be capable of being dried within 20 seconds when heated to 65° C. following washing step. This level of forehardening is sufficient to allow the radiographic element to be acceptably handled and processed. A more detailed description of the processing cycle, including the composition used in each step, is provided by Dickerson et al U.S. Pat. No 4,900,652, the disclosure of which is here incorporated by reference.

It is recognized that the processing cycle described above is a reference for quantifying forehardening. In actual use, different processing cycles and developing solutions can be used.

Tabular grain emulsions that satisfy high bromide grain requirements and gelatino-vehicle requirements, except that the vehicle is fully forehardened, are described in greater detail in the following patents, the disclosures of which are here incorporated by reference:

| | |
|---|---|
| Dickerson | U.S. Pat. No. 4,414,310; |
| Abbott et al | U.S. Pat. No. 4,425,425; |
| Abbott et al | U.S. Pat. No. 4,425,426; |
| Kofron et al | U.S. Pat. No. 4,439,520; |
| Wilgus et al | U.S. Pat. No. 4,434,226; |
| Maskasky | U.S. Pat. No. 4,435,501; |
| Maskasky | U.S. Pat. No. 4,713,320; |
| Dickerson et al | U.S. Pat. No. 4,803,150; |
| Dickerson et al | U.S. Pat. No. 4,900,355; |
| Dickerson et al | U.S. Pat. No. 4,994,355; |
| Dickerson et al | U.S. Pat. No. 4,997,750; |
| Bunch et al | U.S. Pat. No. 5,021,327; |
| Tsaur et al | U.S. Pat. No. 5,147,771; |
| Tsaur et al | U.S. Pat. No. 5,147,772; |
| Tsaur et al | U.S. Pat. No. 5,147,773; |
| Tsaur et al | U.S. Pat. No. 5,171,659; |
| Dickerson et al | U.S. Pat. No. 5,252,442; |
| Dickerson | U.S. Pat. No. 5,391,469; |
| Dickerson et al | U.S. Pat. No. 5,399,470; |
| Maskasky | U.S. Pat. No. 5,411,853; |
| Maskasky | U.S. Pat. No. 5,418,125; |
| Daubendiek et al | U.S. Pat. No. 5,494,789; |
| Olm et al | U.S. Pat. No. 5,503,970; |
| Wen et al | U.S. Pat. No. 5,536,632; |
| King et al | U.S. Pat. No. 5,518,872; |
| Fenton et al | U.S. Pat. No. 5,567,580; |
| Daubendiek et al | U.S. Pat. No. 5,573,902; |
| Dickerson | U.S. Pat. No. 5,576,156; |
| Daubendiek et al | U.S. Pat. No. 5,576,168; |
| Olm et al | U.S. Pat. No. 5,576,171; |
| Deaton et al | U.S. Pat. No. 5,582,965. |

The patents to Abbott et al, Fenton et al, Dickerson and Dickerson et al disclose radiographic elements of type useful in the practice of the invention and are therefore cited and incorporated by reference to show conventional element features in addition to the gelatino-vehicle and high bromide tabular grain emulsions.

Forehardening can be undertaken using conventional forehardeners of the type disclosed by Dickerson U.S. Pat. No. 4,414,904, here incorporated by reference, and *Research Disclosure,* Vol. 389, September 1996, Item 38957, II. Vehicles, vehicle extenders, vehicle-like addenda and vehicle related addenda, B. Hardeners. Typical useful hardeners include formaldehyde and free dialdehydes such as succinaldehyde and glutaraldehyde as illustrated by Allen et al U.S. Pat. No. 3,232,764; blocked dialdehydes as illustrated by Kaszuba U.S. Pat. No. 2,586,168, Jeffreys U.S. Pat. No. 2,870,013 and Yamamoto et al U.S. Pat. No. 3,819,608; α-diketones as illustrated by Allen et al U.S. Pat. No. 2,725,305; active esters of the type described by Bumess et al U.S. Pat. No. 3,542,558; sulfonate esters as illustrated by Allen et al U.S. Pat. Nos. 2,725,305 and 2,726,162; active halogen compounds as illustrated by Burness U.S. Pat. No. 3,106,468, Silverman et al U.S. Pat. No. 3,839,042, Ballantine et al U.S. Pat. No. 3,951,940 and Himmelmann et al U.S. Pat. No. 3,174,861 and Vermeersch et al U.S. Pat. No. 4,879,209; s-triazines and diazines as illustrated by Yamamoto et al U.S. Pat. No. 3,325,287, Anderau et al U.S. Pat. No. 3,288,775, Stauner et al U.S. Pat. No. 3,992,366, Terashima et al U.S. Pat. No. 5,102,780 and Komorita et al EPO 0 244 184; epoxides as illustrated by Allen et al U.S. Pat. No. 3,047,394, Burness U.S. Pat. No. 3,189,459, Vermeersch et al U.S. Pat. No. 4,820,613, Komorita 4,837,143, Helling et al EPO 0 301 313 and Birr et al German OLS 1,085,663; aziridines as illustrated by Allen et al U.S. Pat. No. 2,950,197, Bumess et al U.S. Pat. No. 3,271,175 and Sato et al U.S. Pat. No. 3,575,705; active olefins having two or more active bonds as illustrated by Bumess et al U.S. Pat. Nos. 3,490,911, 3,539,644 and 3,841,872 (Reissue 29,305), Cohen U.S. Pat. No. 3,640,720, Kleist et al German OLS 872,153, Allen U.S. Pat. No. 2,992,109, Itahasi et al U.S. Pat. No. 4,874,687, Okamura et al U.S. Pat. No. 4,897,344, Ikenoue et al U.S. Pat. No. 5,071,736, Delfino et al U.S. Pat. No. 5,246,824 and Helling et al German OLS 3,724,672; blocked active olefins as illustrated by Burness et al U.S. Pat. No. 3,360,372, Wilson U.S. Pat. No. 3,345,177 and Himmelman et al U.S. Pat. Nos. 4,845,0234 and 4,894,324; carbodiimides as illustrated by Blout et al German Patent 1,148,446; isoxazolium salts unsubstituted in the 3-position as illustrated by Bumess et al U.S. Pat. No. 3,321,313; esters of 2-alkoxy-N-carboxydihydroquinoline as illustrated by Bergthaller et al U.S. Pat. No. 4,013,468; N-carbamoyl pyridinium salts as illustrated by Himmelmann et al U.S. Pat. Nos. 3,880,665 and 4,063,952, Okamura et al U.S. Pat. No. 4,828,974, Schranz et al U.S. Pat. No. 4,865,940, Roche et al U.S. Pat. No. 4,978,607, Schweicher et al U.S. Pat. No. 4,942,068 and Helling et al EPO 0 370 226; carbamoyl oxypyridinium salts as illustrated by Bergthaller et al U.S. Pat. No. 4,055,427; bis(imoniomethyl) ether salts, particularly bis(amidino) ether salts, as illustrated by Chen et al U.S. Pat. No. 4,877,724 and Riecke et al WO 90/02357, surface-applied carboxyl-activating hardeners in combination with complex-forming salts as illustrated by Sauerteig et al U.S. Pat. No. 4,119,464; carbamoylonium, carbamoyl pyridinium and carbamoyl oxypyridinium salts in combination with certain aldehyde scavengers as illustrated by Langen et al U.S. Pat. No. 4,418,142; dication ethers as illustrated by Chen et al European Patent Application EP 281,146; hydroxylamine esters of imidic acid salts and chloroformamidinium salts as illustrated by Okamura et al U.S. Pat. Nos. 4,612,280 and 4,673,632; hardeners of mixed function such as halogen-substituted aldehyde acids (e.g., mucochloric and mucobromic acids) as illustrated by White U.S. Pat. No. 2,080,019, onium-substituted acroleins, as illustrated by Tschopp et al U.S. Pat. No. 3,792,021, and vinyl sulfones containing other hardening functional groups as illustrated by Sera et al U.S. Pat. No. 4,028,320; and polymeric hardeners such as dialdehyde starches as illustrated by Jeffreys et al U.S. Pat. No. 3,057,723, and copoly (acrolein-methacrylic acid) as illustrated by Himmelmann et al U.S. Pat. No. 3,396,029.

EXAMPLES

Grain coating coverages are based on the weight of silver. Speed is reported in relative log units—that is 100 units= 1.00 log E, where E is exposure in lux-seconds. Coating coverages are in mg/dm$^2$, unless otherwise stated.

Examples 1 and 2

These examples demonstrate the unexpected combined effectiveness of the category (b) and selected category (c) covering power enhancers in improving both covering power and image tone.

A series of coatings were prepared on a 7 mil (179 μm) clear poly(ethylene terephthalate) film support. Since the support was clear and not blue tinted, reported b* values are much more positive (warmer) than are acceptable for a radiographic element satisfying the requirements of the invention. However, these examples demonstrate the relative contributions of the components compared to obtaining colder image tones. The suffixes indicate components that are not useful (c) or are useful (ex) in the radiographic elements of the invention.

Example 1

Coating A

A silver bromide tabular grain emulsion having a mean ECD of 1.6 μm and a mean tabular grain thickness of 0.13 μm was spectrally sensitized with anhydro-3,3'-bis(3-sulfopropyl)-5,5'-dichloro-9-ethyloxacarbocyanine hydroxide, sodium salt (SS-1) and optimally chemically sensitized with sodium thiosulfate, tetrachloroaurate, and potassium selenocyanate. Potassium iodide in the amount of 300 mg/Ag mole and 1 g/Ag mole of the sodium salt of 4-hydroxy-6-methyl-1,3,3a,7-tetraazaindene were added to the emulsion.

The emulsion was then coated at a silver coverage of 17.2 mg/dm$^2$ and 31.2 mg/dm$^2$ of gelatin. An overcoat of 7.2 mg/dm$^2$ gelatin containing bis(vinylsulfonylmethyl)ether in the amount of 2.2 weight percent, based on the total weight of gelatin in both layers was incorporated as a hardener.

Coating B

Coating A was replicated, except that the category (b) covering power enhancers 4-hydroxy-6-methyl-2-methylmercapto-1,3,3a,7-tetraazaindene (400 mg/Ag mole) and 2-mercapto-1,3-benzothiazole (30 mg/Ag mole) were added.

Coating C

Coating A was replicated, except that 6.4 mg/dm2 of the water soluble polymer dextran (m.w.=40,000), a category (c) covering power enhancer, was added to the emulsion layer.

Coating D

Coating B was replicated, except that 6.4 mg/dm2 of the water soluble polymer dextran (m.w.=40,000), a category (c) covering power enhancer, was added to the emulsion layer.

Coating E

Coating D was replicated, except that the dextran was replaced with an equal amount of the category (c) covering power enhancer polyacrylamide (m.w.=40,000).

Coating F

Coating D was replicated, except that the dextran was replaced with an equal amount of the category (c) covering power enhancer poly(vinyl pyrrolidone (m.w.=40,000).

The coatings were each exposed to a 546 nm mercury emission line and processed using a conventional hydroquinone-Elon ä (p-N-methylaminophenol hemisulfate) developer.

The results are summarized in Table I.

TABLE I

| CE | CPE-(b) | CPE-(c) | CP | b* |
|---|---|---|---|---|
| Ac | No | No | 9.02 | 2.7 |
| Bc | Yes | No | 10.04 | 2.7 |
| Cc | No | DEX | 10.13 | 2.9 |
| Dex | Yes | DEX | 10.78 | 2.2 |
| Eex | Yes | PAA | 10.87 | 2.1 |
| Fc | Yes | PVP | 10.87 | 4.0 |

CE = Coated Element
CPE-(b) and CPE-(c) = category (b) and (c) covering power enhancers
CP = covering power
DEX = dextran
PAA = polyacrylamide
PVP = poly(vinyl pyrrolidone)

From Table I it is apparent that the lowest covering power was obtained when no covering power enhancer was present. When a category (b) covering power enhancer was added, covering power increased while image tone remained unchanged.

When the category (c) covering power enhancer dextran was added without adding a category (b) covering power enhancer, covering power enhancement occurred while image tone became somewhat warmer, as indicated by the higher b* value.

When dextran or polyacrylamide were added to the coatings containing the category (c) covering power enhancer, a further increase in covering power occurred and, quite unexpectedly, a significantly colder image tone was realized. It was entirely unexpected that the combination of the category (b) covering power enhancers and the category (c) covering power enhancers dextran and polyacrylamide would produce a colder image tone than produced by the use of either covering power enhancer alone or in the absence of both covering power enhancers.

Still further, once the image tone improvement realized by using dextran or polyacrylamide with a category (b) covering power enhancer was realized, it was surprising that poly(vinyl pyrrolidone), also a category (c) covering power enhancer, did not produce a colder image tone, but actually produced a large shift toward a warmer image tone.

Example 2

This example in part repeated the coatings and observations of Example 1 and in part substituted the alternative category (b) covering power enhancer 5-(3-ethyl-2[3H]-benzoxazoylidene)-3-phenylrhodanine (RHOD) or substituting for the category (c) covering power enhancer poly (vinyl alcohol) (PVA) or polyethylene glycol (PEG).

The results are summarized in Table II.

TABLE II

| | CPE-(b) | CPE-(c) | SPD | Dmin | CP | b* |
|---|---|---|---|---|---|---|
| Ac | No | No | 179 | 0.05 | 9.02 | 2.42 |
| Bc | Ex. 1 | No | 183 | 0.05 | 9.94 | 2.30 |
| Cex | Ex. 1 | DBX | 179 | 0.05 | 10.69 | 1.78 |
| Dex | Ex. 1 | PAA | 178 | 0.05 | 10.50 | 2.13 |
| Ec | Ex. 1 | PVA | 183 | 0.06 | 10.13 | 2.81 |
| Fc | Ex. 1 | PVP | 181 | 0.06 | 10.59 | 3.33 |
| Gc | Ex. 1 | PEG | 186 | 0.12 | 10.50 | 3.57 |
| Hc | RHOD | No | 178 | 0.06 | 9.76 | 2.39 |
| Iex | RHOD | DEX | 170 | 0.05 | 10.32 | 1.82 |

SPD = Speed, which was measured at a density of 0.2 above minimum density.

From Table II it is apparent that the category (b) covering power enhancers in combination with the category (c) covering power enhancer polyacrylamide or dextran improve covering power and produce colder image tones. Substitution of poly(vinyl alcohol), poly(vinyl pyrrolidone) or polyethylene glycol as a category (c) covering power enhancer results in much warmer image tones. Polyethylene glycol also increases fog.

Example 3

This example demonstrates the contribution of various components in reaching a radiographic element construction satisfying the requirements of the invention.

All coating coverages are in mg/dm$^2$. Grain coverages are based on the weight of silver.

Element A(c)

A radiographic element was constructed by coating onto both major faces a blue tinted 7 mil (178 μm) poly(ethylene terephthalate) film support (S) having a neutral density of 0.18 an emulsion layer (EL), an interlayer (IL) and a transparent surface overcoat (SOC), as indicated:

| |
|---|
| SOC |
| IL |
| EL |
| S |
| EL |
| IL |
| SOC |

| Contents | Coverage |
|---|---|
| **Emulsion Layer (EL)** | |
| Ag | 18.3 |
| Gelatin | 31.2 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |
| Bis(vinylsulfonylmethyl)ether (based on wt. of gelatin in all layers) | 2.4% |
| **Interlayer (IL)** | |
| Gelatin | 3.4 |
| AgI Lippmann | 0.11 |
| Carboxymethyl casein | 0.57 |
| Colloidal silica | 0.57 |
| Polyacrylamide | 0.57 |
| Chrome alum | 0.025 |
| Resorcinol | 0.058 |
| Nitron | 0.044 |
| **Surface Overcoat (SOC)** | |
| Gelatin | 3.4 |
| Poly(methyl methacrylate) matte beads | 0.14 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |

The Ag in EL was provided in the form a thin, high aspect ratio tabular grain silver bromide emulsion in which the tabular grains accounted for greater than 90 percent of total grain projected area, exhibited an average equivalent circular diameter (ECD) of 1.8 μm, an average thickness of 0.13 μm. The grains exhibited a COV of 30 percent. The tabular grain emulsion was sulfur and gold sensitized and spectrally sensitized with 400 mg/Ag mole of anhydro-5,5-dichloro-9-ethyl-3,3'-bis(3-sulfopropyl)oxacarbocyanine hydroxide, sodium salt, followed by the addition of 300 mg/Ag mole of KI. The AgI Lippmann emulsion present in IL exhibited a mean ECD of 0.08 μm.

Element B(c)

This element constructed identically to Element A(c), except that the mean ECD of the emulsion grains was 2.0 μm, the mean thickness of the grains was 0.10 μm, and the silver coverage was reduced to 13.1 mg/dm$^2$. The tabular grains accounted for greater than 97 percent of total grain projected area and the COV of the grains was 17 percent. Because of the slightly higher average aspect ratio of the grains, a slightly higher amount of the spectral sensitizing dye, 590 mg/Ag mole, was required for optimum sensitization.

Element C(c)

This element was identical to Element B, except for the addition to the emulsion layers of the following category (b) covering power enhancers:

| | |
|---|---|
| 4-Hydroxy-6-methyl-2-methylmercapto-1,3,3a,7-tetraazaindene | 400 mg/Ag mole |
| 2-Mercapto-1,3-benzothiazole | 30 mg/Ag mole. |

Element D(c)

This element was identical to Element C, except for the addition to the emulsion layers of category (c) covering power enhancers and carboxymethyl casein, used to improve dispersion:

| | Coverage |
|---|---|
| Dextran | 5.38 |
| Polyacrylamide | 2.69 |
| Carboxymethyl casein | 1.61. |

Element E(ex)

This element was identical to Element D, except that the hardener was reduced to 0.8 weight percent, based on the weight of gelatin, and the silver coverage in each emulsion layer was reduced to 11.8 mg/dm$^2$.

Sensitometry

Each of Elements A thru E were mounted between a pair of Lanex™ regular intensifying screens and exposed to 70 KVp X-radiation using a 3-phase Picker Medical (Model VTX-650)™ exposure unit containing filtration of up to 3 mm of Al. Sensitometric gradations in exposure were achieved by using a 21 increment (0.1 log E, where E represents exposure in lux-seconds) Al step wedge of varying thickness.

The exposed elements were processed using a Kodak X-Omat™ M6A-N film processor set for a 90 seconds processing cycle:

| | |
|---|---|
| Development | 24 seconds at 40° C. |
| Fixing | 20 seconds at 40° C. |
| Washing | 10 seconds at 40° C. |
| Drying | 20 seconds at 65° C. |

where the time not otherwise accounted for was taken up in transport between stages.

The composition of the developer was as follows:

| | |
|---|---|
| Hydroquinone | 30 g |
| 4-Hydroxymethyl-4-methyl-1-phenyl-3-pyrazolidinone | 1.5 g |
| KOH | 21 g |
| $NaHCO_3$ | 7.5 g |
| $K_2SO_3$ | 44.2 g |
| $Na_2S_2O_5$ | 12.6 g |
| 5-Methylbenzotriazole | 0.06 g |
| Glutaraldehyde | 4.9 g |
| Water to 1 Liter (pH = 10) | |

Optical densities are expressed in terms of diffuse density as measured by an X-rite Model 310TM densitometer, which was calibrated to ANSI standard PH 2.19 and was traceable to a National Bureau of Standards calibration step tablet. The characteristic curve (density vs. log E) was plotted for each radiographic element processed.

Hardener Level

Although hardener levels are reported above in terms of weight percent hardener, based on the weight of the gelatino-vehicle, it is appreciated that these levels are dependent on the specific choice of hardener.

To translate the degree of hardening into a general hardening level that is independent of the specific hardener chosen, the rapid access processor was stopped as a sample of each radiographic element began to emerge from the dryer. By opening the drying section of the processor with the film in place it was possible to observe what percentage of the total drying step was required to fully dry the radiographic element. This level of hardening is reported below in Table III in terms of the seconds within the drying stage.

TABLE III

| Element | Drying Time (sec.) |
|---|---|
| A(c) | 4 |
| B(c) | 3 |
| C(c) | 3 |
| D(c) | 3 |
| E(ex) | 13 |

From Table III it is apparent that Element E(ex) exhibited as significantly lower level of hardening than the remaining elements.

To provide still another, more generally applicable parameter for comparing hardening, samples of the film were weighed as they left the washing stage of the processor and before they reached the dryer. This provided a measure of the percent weight gain, based on the weight of gelatino-vehicle present in the element before processing. This measurement allows the degree of hardening to be compared in elements containing widely differing gelatino-vehicle coating coverages. The results are summarized in Table IV.

TABLE IV

| Element | Percent Weight Gain |
|---|---|
| A(c) | 182 |
| B(c) | 171 |
| C(c) | 176 |
| D(c) | 186 |
| E(ex) | 276 |

Speed

The varied structural parameters of the films and speed are compared in Table V. Speed was measured at a density of 1.00 above $D_{min}$.

TABLE V

| Element | CPE (b)/(c) | Ag mg/dm$^2$ | % Wt. Gain | Speed |
|---|---|---|---|---|
| A(c) | No/No | 18.3 | 182 | 85 |
| B(c) | No/No | 13.1 | 171 | 85 |
| C(c) | Yes/No | 13.1 | 176 | 87 |
| D(c) | Yes/Yes | 13.1 | 186 | 92 |
| E(ex) | Yes/Yes | 11.8 | 276 | 85 |

From Table V it is apparent that despite a 36% reduction in the silver coating coverage, no loss of imaging speed was observed.

Crossover

Percent crossover was measured as described in Abbott et al U.S. Pat. No. 4,425,425, the disclosure of which is here incorporated by reference. Observed crossover (X/O) is reported in Table VI.

TABLE VI

| Element | CPE (b)/(c) | Ag mg/dm$^2$ | % Wt. Gain | % X/O |
|---|---|---|---|---|
| A(c) | No/No | 18.3 | 182 | 33 |
| B(c) | No/No | 13.1 | 171 | 25 |
| C(c) | Yes/No | 13.1 | 176 | 26 |
| D(c) | Yes/Yes | 13.1 | 186 | 26 |
| E(ex) | Yes/Yes | 11.8 | 276 | 28 |

From Table VI it is noted that, despite the 36% reduction in Ag coating coverages, Element E, satisfying the requirements of invention exhibited a lower crossover than control Element A.

Dye Stain

Residual dye stain was measured using spectrophotometric methods and calculated as the difference between density at 505 nm, which corresponds to the dye absorption peak, and the density at 440 nm, which outside the spectral region of dye absorption and within the spectral absorption region of developed silver. Measurements were performed on film samples that were processed, but not exposed. Thus, the only silver density present was attributable to fog. By taking the difference in densities, fog was eliminated from the dye stain measurements.

Observed dye stain is reported in Table VII.

TABLE VII

| Element | CPE (b)/(c) | Ag mg/dm$^2$ | % Wt. Gain | Dye Stain |
|---|---|---|---|---|
| A(c) | No/No | 18.3 | 182 | 0.05 |
| B(c) | No/No | 13.1 | 171 | 0.03 |
| C(c) | Yes/No | 13.1 | 176 | 0.04 |
| D(c) | Yes/Yes | 13.1 | 186 | 0.03 |
| E(ex) | Yes/Yes | 11.8 | 276 | 0.02 |

From Table VII it is noted that Element E, satisfying the requirements of invention, exhibited the lowest observed dye stain.

γ/Dmax

Observed maximum densities and average contrast are reported in Table VIII.

TABLE VIII

| Element | CPE (b)/(c) | Ag mg/dm$^2$ | % Wt. Gain | γ/Dmax |
|---|---|---|---|---|
| A(c) | No/No | 18.3 | 182 | 2.6/3.1 |
| B(c) | No/No | 13.1 | 171 | 2.6/2.9 |
| C(c) | Yes/No | 13.1 | 176 | 2.9/3.0 |
| D(c) | Yes/Yes | 13.1 | 186 | 2.9/3.3 |
| E(ex) | Yes/Yes | 11.8 | 276 | 3.0/3.1 |

From Table VIII it is apparent that Element A(c), exhibiting a COV of 30%, failed to provide a contrast of at least 2.7. When a thinner, 17% COV emulsion, Element B(c), was substituted at a 28% reduction in silver coverage, it also failed to satisfy minimum average contrast requirements and also failed to provide an acceptably high maximum density. With the addition of the covering power enhancers, both average contrast and maximum density requirements were satisfied in the remaining elements. Surprisingly, maximum density and average contrast requirements were still met in Element E(ex), even though the silver coverage reduction was increased to 36%.

Image Tone

Observed b* values are reported in Table IX.

TABLE IX

| Element | CPE (b)/(c) | Ag mg/dm$^2$ | % Wt. Gain | b* |
|---|---|---|---|---|
| A(c) | No/No | 18.3 | 182 | −6.3 |
| B(c) | No/No | 13.1 | 171 | −5.1 |
| C(c) | Yes/No | 13.1 | 176 | −5.3 |
| D(c) | Yes/Yes | 13.1 | 186 | −5.6 |
| E(ex) | Yes/Yes | 11.8 | 276 | −5.1 |

The significant positive shift of b* values between Elements A(c) and B(c) was expected, since it is known in the art that decreasing the average thickness of tabular grains produces a shift toward warmer image tones. While Elements B(c) and C(c) satisfied the requirement of a b* value more negative than −5.0, they failed to provide acceptable average contrast and/or maximum density, as noted above.

It was surprising that when the category (b) and (c) covering power enhancers were used together to bring up average contrast and maximum density to acceptable levels, a shift toward colder image tones was also realized.

This shift toward colder image tones allowed a further reduction in silver coating coverages to less than 12 mg/dm$^2$ while still satisfying the image tone objective of maintaining a b* value more negative than −5.0.

SUMMARY OF OBSERVATIONS

Only Element E(ex) fully satisfied the requirements of the invention. It provided an average contrast of greater than 2.7 and a maximum density of greater than 3.0 with a minimal silver coating coverage of less than 12.0 mg/dm$^2$ while, surprisingly, maintaining an acceptably cold image tone, represented by a b* value more negative than −5.0. At significantly higher silver coating coverages Elements A(c) and B(c) failed to satisfy average contrast and/or maximum density requirements. Element A(c) exhibited the highest crossover of all elements compared. By comparing Elements B(c), C(c) and D(c), it is apparent that the category (b) and (c) covering power enhancers produced an unexpected shift toward colder image tones. Element E(ex), satisfying the requirements of the invention balanced the b* advantage provided by this combination of covering power enhancers against a b* disadvantage resulting from further covering power enhancement attributable to limited hardening to reduce silver coating coverage to a minimal level while staying within acceptable performance (γ, Dmax, b*) criteria. It was entirely unexpected that such a useful balance of properties could be realized while minimizing silver coating coverages. Further, Element E(ex) exhibited low crossover, the lowest observed dye stain, and acceptable speed. Finally, the Examples demonstrate that, unpredictably, it is only the water soluble polymer covering power enhancers acrylamide and dextran that produce the unexpectedly colder image tones when used in combination with category (b) covering power enhancers. Thus, the overall characteristics of the radiographic elements of the invention are demonstrated to flow from surprising and unpredicted observations.

The invention has been described in detail with particular reference to preferred embodiments thereof, but it will be understood that variations and modifications can be effected within the spirit and scope of the invention.

What is claimed is:

1. A radiographic element comprised of a blue tinted film support having first and second major surfaces and, coated on each of the major surfaces of the support, at least one layer containing a tabular grain emulsion including a gelatino-vehicle and spectrally sensitized silver halide grains containing greater than 50 mole percent bromide and less than 3 mole percent iodide, based on silver, WHEREIN the properties of a maximum density of at least 3.0, an average contrast of at least 2.7, and a b* value more negative than −5.0 at a silver coating coverage on each major surface of the support of less than 12 mg/dm$^2$, are imparted by the support having a neutral density of at least 0.18, tabular grains accounting for at least 90 percent of total grain projected area having a mean thickness of 0.2 micrometer or less and a coefficient of variation of equivalent circular diameter less than 20 percent, a covering power enhancing compound containing at least one divalent sulfur atom adsorbed to surfaces of the silver halide grains, a water soluble polymer chosen from the class consisting of polyacrylamide and dextran, in a weight ratio of the polymer to the gelatino-vehicle of at least 0.1:1, and hardening of the gelatino-vehicle being chosen to allow a weight gain of greater than 200 percent, based on the total weight of gelatino-vehicle, after the following process cycle:

| | |
|---|---|
| development | 24 seconds at 40° C. |
| fixing | 20 seconds at 40° C., |
| washing | 10 seconds at 40° C., |

when the developer exhibits the composition:

| | |
|---|---|
| hydroquinone | 30 g |
| 4-hydroxymethyl-4-methyl-1-phenyl-3-pyrazolidinone | 1.5 g |
| KOH | 21 g |
| $NaHCO_3$ | 7.5 g |
| $K_2SO_3$ | 44.2 g |
| $Na_2S_2O_5$ | 12.6 g |
| 5-methylbenzotriazole | 0.06 g |
| glutaraldehyde | 4.9 g |
| water to 1 liter (pH = 10) | |

while allowing subsequent drying at 65° C. within 20 seconds.

2. A radiographic element according to claim 1 wherein the water soluble polymer is dextran.

3. A radiographic element according to claim 1 wherein the water soluble polymer is polyacrylamide.

4. A radiographic element according to claim 1 wherein the weight ratio of the water soluble polymer to the gelatino-vehicle is in the range of from 0.1:1 to 1:1.

5. A radiographic element according to claim 4 wherein the weight ratio of the water soluble polymer to the gelatino-vehicle is in the range of from 0.25:1 to 0.75:1.

6. A radiographic element according to claim 1 wherein the adsorbed covering power enhancing compound contains an azole or azine ring.

7. A radiographic element according to claim 6 wherein the covering power enhancing compound is capable of forming a silver salt and contains an azole or azine ring having adjacent a trivalent ring nitrogen atom a ring carbon atom that is substituted with a sulfur containing moiety that forms a mercapto substituent of the ring carbon atom or forms with the ring carbon atom a thioxocarbonyl group.

8. A radiographic element according to claim 7 wherein the adsorbed covering power enhancing compound is a mercapto substituted tetrazole or tetraazaindene.

9. A radiographic element according to claim 7 wherein the covering power enhancing compound includes a rhodanine ring.

10. A radiographic element according to claim 7 wherein the adsorbed covering power enhancing compound includes a benzothiazole, benzoxazole or benzimidazole ring.

11. A radiographic element according to claim 1 wherein the tabular grains account for greater than 97 percent total grain projected area and the coefficient of variation of grain equivalent circular is 10 percent or less.

12. A radiographic element according to claim 1 wherein the subsequent drying at 65° C. is completed within 13 seconds.

* * * * *